US005285182A

United States Patent [19]

Zarembo

[11] Patent Number: 5,285,182

[45] Date of Patent: Feb. 8, 1994

[54] DESENSITIZING APPARATUS FOR ELECTROMAGNETIC ARTICLE SURVEILLANCE SYSTEM

[75] Inventor: Peter J. Zarembo, Shoreview, Minn.

[73] Assignee: Minnesota Mining and Manufacturing Company, St. Paul, Minn.

[21] Appl. No.: 940,007

[22] Filed: Sep. 3, 1992

[51] Int. Cl.[5] ..... H01F 7/20

[52] U.S. Cl. ..... 335/284; 340/551

[58] Field of Search ..... 335/284, 306; 340/551, 340/572

[56] References Cited

U.S. PATENT DOCUMENTS

| | | | |
|---|---|---|---|
| 3,665,449 | 5/1972 | Elder et al. . | |
| 4,499,444 | 2/1985 | Heltemes et al. . | |
| 4,665,387 | 5/1987 | Cooper et al. . | |
| 4,684,930 | 8/1987 | Minasy et al. . | |
| 4,746,908 | 5/1988 | Montean . | |
| 4,752,758 | 6/1988 | Heltemes | 340/572 |
| 4,811,000 | 3/1989 | Humphrey et al. . | |
| 4,857,891 | 8/1989 | Heltemes . | |
| 5,008,649 | 4/1991 | Klein . | |
| 5,121,106 | 6/1992 | Kataria et al. | 340/572 |
| 5,126,720 | 6/1992 | Zhou et al. . | |
| 5,170,045 | 12/1992 | Bentgsson . | |
| 5,187,354 | 2/1993 | Bengtsson . | |
| 5,187,462 | 2/1993 | Montean . | |

*Primary Examiner*—Lincoln Donovan

*Attorney, Agent, or Firm*—Gary L. Griswold; Walter N. Kirn; Eric D. Levinson

[57] ABSTRACT

A desensitizing apparatus for magnetizing a desensitizable marker used with an electromagnetic article surveillance system. The apparatus includes a rectangular, non-metallic plate positioned so that its length is perpendicular to a likely direction of travel of the marker to be magnetized. A row of X-shaped arrays of elongated magnets is embedded on the plate. A marker passing over the row of magnets will be desensitized regardless of its orientation or direction of travel over the magnets.

24 Claims, 3 Drawing Sheets

DESENSITIZING APPARATUS FOR ELECTROMAGNETIC ARTICLE SURVEILLANCE SYSTEM

FIELD OF THE INVENTION

This invention relates to electromagnetic article surveillance (EAS) systems of the type in which an alternating magnetic field is applied within an interrogation zone and the presence of a high-permeability, low coercive force ferromagnetic marker within the zone is detected based on signals produced by the marker in response to the applied field. In particular, the present invention relates to such systems in which the marker includes both a high-permeability, low coercive force portion and at least one magnetizable section having a higher coercive force, and which when magnetized alters the detectable signal otherwise produced, and the invention is directed to an apparatus for magnetizing the higher coercive force section of such markers.

BACKGROUND OF THE INVENTION

EAS systems of the type described above, are, for example, disclosed and claimed in U.S. Pat. No. 3,665,449 (Elder et al.). As set forth at Col. 5, lines 10 to 39 therein, a dual status marker of the type described above may be desensitized, i.e., the high-coercive force section thereof magnetized, by placing the marker in the field of a large permanent magnet of sufficient intensity, and gradually removing the field, such as by withdrawing the marker therefrom. As also there disclosed, such a magnetization operation may be effected by imposing on the marker a unipolar pulsed field of gradually decreasing intensity.

While such techniques may be useful in many areas and with the markers affixed to a wide variety of articles, the magnetic fields associated therewith have been found to unacceptably interfere with magnetic states associated with certain articles. For example, the compact size and popularity of prerecorded magnetic audio and video cassettes make such articles frequent targets for shoplifters, and hence likely articles with which anti-theft markers would be used. At the same time however, such affixed markers would be desirably desensitized upon purchases, and it has been found that prior art desensitizing apparatus such as described above may unacceptably affect signals prerecorded on magnetic tapes within the cassettes.

To avoid such deleterious effects on prerecorded magnetically sensitive articles, it is also known to provide apparatus in which a steady-state field is produced which rapidly decreases in intensity with increased distance from the apparatus. Thus, such an apparatus improves the likelihood of magnetizing high-coercive force sections of a marker brought close thereto without interfering with the magnetic signals recorded on tapes within a cassette to which the marker is affixed. See U.S. Pat. No. 4,499,444 (Heltemes et al.). The apparatus described by Heltemes et al. comprises a permanent magnet assembly which includes at least one section of a permanent magnet ferromagnetic material having two substantially opposed major surfaces and a pair of pole pieces each of which is proximate to and extends over a major portion of the major surfaces and terminates proximate to the other pole piece, leaving a gap therebetween of substantially constant width extending along the length of the permanent magnet material. The permanent magnet material is substantially uniformly magnetized to present one magnetic polarity at one of the major surfaces and the opposite polarity on the other major surface. The pole pieces in turn concentrate external magnetic lines of flux resulting from the magnetized material near the gap. The resultant external magnetic field decreases rapidly with increasing distance from the gap, and enables a marker to be moved relative to the gap to magnetize the section of said high coercive force material within the marker while not altering magnetic states such as may exist within an article to which the marker is secured.

An apparatus such as described by Heltemes et al. has generally been found to be satisfactory so long as it is used with markers of a single type, and whose magnetizable components all have a coercive force within a given range, such that the field intensity at the working surface of the apparatus is controlled to appropriately magnetize those components while not adversely affecting magnetically sensitive articles. Conversely, it has been found that when the apparatus is used with markers nominally of the same type, but in which the value of the coercive force varies over a relatively wide range of allowed values, certain conditions may cause unsatisfactory results.

For example, to prevent adverse effects on magnetically sensitive articles with which the markers are desirably used, the field intensity at some distance from the working surface of the apparatus at which such magnetically sensitive articles are to be located, must be below certain design limits. However, a practical apparatus desirably has an effective operable range extending a short distance above the surface within which all allowed materials must become magnetized. Some materials having coercive forces near the highest allowed value and positioned near the outer edge of the allowed range, i.e., in the weakest fields, may not become sufficiently magnetized. And, since there is typically a reverse directed back field, which is particularly strong near the surface of the apparatus, such back fields may be sufficient to reduce the magnetization state in materials near the surface and having coercive forces near the lowest allowed value. Such reduced magnetization levels could, in turn, inadequately bias the low coercive, high permeability material of the marker, such that the response of the marker would be inadequately altered. Such effects are further compounded and totally unacceptable results may occur, if markers of significantly different types, each having magnetizable materials having coercive forces in significantly different ranges are used with the same apparatus.

Permanent magnet assemblies such as those described by Heltemes et al. are designed to concentrate magnetic flux across a gap defined by specially configured pole pieces. While most of the flux may flow across the gap, there may also be an appreciable fringe, or back field having an opposite polarity to that across the gap. Even at a relatively short distance above the gap, such as at the working surface of the apparatus described above, such a back field may have an intensity of several percent of the forward flux flowing across the gap. In constructions like that shown in the referenced patent, at short distances above the gap, the back field may exceed 6% of the field directly over the gap.

The desensitizable markers used in EAS systems may have magnetizable elements in a range of coercive forces. For example, the apparatus may be desirably designed to operate with three distinct types of markers, all having at least one responder section of a high permeability, low coercive force material such as permalloy and at least one magnetizable section. One such marker has a magnetizable element with a coercive force in the range of 24,000–28,000 A/m (300 to 350 oersteds), a second type has a magnetizable element with a coercive force in the range of 14,400–18,400 A/m (180 to 230 oersteds), and a third type has a magnetizable element with a coercive force in the range of 4,800–7,200 A/m (60–90 oersteds). Such markers may, for example, be type QT Quadratag TM, Type WH-0117 Whispertape TM and type QTN Quadratag TM markers, respectively, all of which are sold by Minnesota Mining and Manufacturing Company (3M), St. Paul, Minn.

It has been generally observed that a field of about 1.5 times the coercive force is needed to reliably magnetize such magnetizable materials, while oppositely directed field intensities of about 0.5 times the coercive force may appreciably lower the residual magnetization. Thus, field intensities of about 1.5 times the coercive force are required to magnetize such elements at the maximum distance from the working surface at which a marker would reasonably be expected to be. Based on normal field attenuation, the field right at the working surface would be appreciably higher, e.g., about twice the coercive force. And, a back field 6% that of the primary field would then be about 12% of the coercive force. Thus, a forward field of sufficient intensity to magnetize elements having a maximum coercive force of about 28,000 A/m (350 oersteds) would have a back field of about 3360 A/m (42 oersteds). Such an oppositely directed back field could then adversely affect, e.g., partially demagnetize, a magnetizable element having a coercive force of less than 8000 A/m (100 oersteds).

The problem is accentuated when highly anisotropic magnetizable elements are used in markers. For example, such an anisotropic material, having a nominal coercive force of about 25,600 A/m (320 oersteds) is used in the type QT Quadratag TM markers discussed above. Since the alignment of the marker when used in the apparatus is uncontrolled, intensities of 48,000–64,000 A/m (600–800 oersteds) are necessary to reliably magnetize such materials. Such intensities at the working surface of the apparatus may correspond to an intensity of about 96,000 A/m (1200 oersteds). And such a front field could have associated back field of about 6400 A/m (80 oersteds), which is sufficient to adversely affect the magnetization of magnetizable elements having a coercive force less than about 14,400 A/m (180 oersteds), such as markers of the second and third types identified above.

U.S. Pat. No. 5,187,462 (Montean) addresses the back field problem by using a plurality of magnetic assemblies, each presenting a successively weaker field at the working surface, where each successively weaker forward field is sufficiently intense to restore the magnetization in an element partially demagnetized by the back field of a preceding assembly. However, even the use of the plurality of magnet assemblies taught by Montean does not totally eliminate the effects of back fields. Some back field always remains, and consequently, some markers may be accidently demagnetized.

Today, the retail recording industry is considering the option of applying markers at various locations on the article, and in various orientations. The Heltemes and Montean references presume that the location and orientation of the marker is known. Markers that are not properly oriented with respect to the direction of motion of the marker over the desensitizing apparatus may not be magnetized. Furthermore, multiple markers may be used, and these markers may be rotated with respect to each other. This increases the chance that one of the markers on the article will not be properly magnetized by the desensitizer.

It would be desirable to have a demagnetizing apparatus: (1) that eliminated the back field problem, (2) whose magnetic field strength decreased rapidly away from the magnet assembly, and (3) that functioned independently of the orientation of the marker with respect to the direction of travel of the marker over the apparatus.

SUMMARY OF THE INVENTION

The present invention includes a desensitizing apparatus for magnetizing a desensitizable marker used with an electromagnetic article surveillance system. The apparatus includes a housing which is adapted to support an article as a marker secured thereto is moved past the apparatus. The housing is also adapted to constrain the article along a direction of travel over the housing. The apparatus also includes an elongated, high density magnet which is positioned in a plane substantially parallel with and proximate to the surface of the housing adapted to support the article. The length of the magnet is substantially perpendicular to the direction of travel of the marker and it provides a magnetic field which is aligned substantially normal to its length. The strength of the magnetic field decreases by about $1/r^2$, for r greater than 1 mm, where r is the distance above the magnet. As used herein, "about $1/r^2$" means within the range of from about $1/r^{1.7}$ to $1/r^{2.1}$. This rapid drop-off in magnetic field strength enables the marker to be remanently magnetized without altering the magnetic state of the article to which the marker is affixed. The magnetic field is sufficiently strong to magnetize the marker but does not subject the marker to a back field which would partially resensitize the marker.

In one embodiment, the magnet is a rare earth, transition metal alloy, preferably neodynium-iron-boron, and has a square-shaped cross-section perpendicular to its length of less than about 1.3 mm by 1.3 mm. The magnet preferably has a peak magnetic energy product of at least about 15,000 Megagauss-oersteds and behaves like a dipole having north and south poles on opposite surfaces of the magnet.

The present invention also includes a desensitizing apparatus having at least two elongated magnets positioned in a plane proximate to and substantially parallel with the surface of a housing adapted to support the article. Each magnet provides a magnetic field aligned substantially normal to its length and parallel to the aforementioned surface of the housing. The lengths of the two magnets are substantially perpendicular to each other. A marker which passes over each of the magnets will be magnetized and therefore desensitized regardless of its orientation relative to the magnets.

The present invention further includes a desensitizing apparatus having a rectangular, non-magnetic plate positioned in the surface of the housing adapted to support the article. The length of the plate is perpendicular to a likely direction of travel of the marker to be magnetized. A plurality of X-shaped arrays of elongated magnets are embedded in the plate. The X-shaped arrays meet at their ends to form a straight row of X's which is parallel to the length of the plate. A marker passing over the row of magnets will be desensitized regardless of its orientation or direction of travel over the magnets.

DETAILED DESCRIPTION

Figure 1:
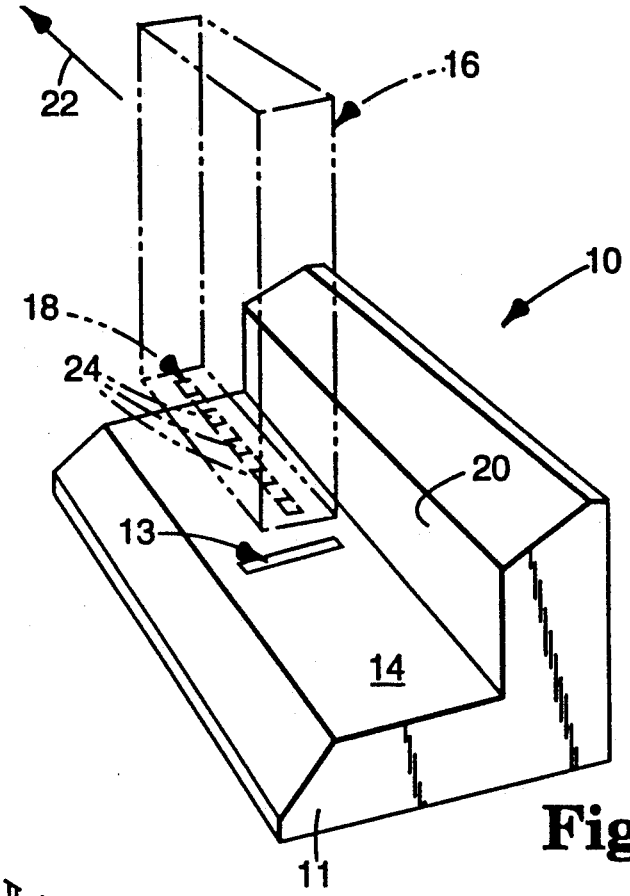
FIG. 1 is a perspective view of one embodiment of the desensitizing apparatus of the present invention.

As shown in FIG. 1, the desensitizing apparatus of the present invention may be in the form of a desk mounted apparatus 10 having a housing 11 and a magnet 13. The magnet 13 may be covered by an optional non-magnetic cover plate (not shown) which both covers and protects the magnet and also provides a wear surface over which an article 16 having a desensitizable marker 18 affixed thereto may be passed during the use of the desensitizing apparatus 10. For example, the cover plate may comprise a polished strip of a copper-nickel-zinc alloy having a thickness in the range of 10 mils (0.25 mm). The use of a polished metallic cover plate may be desired as such a surface resists scratching or chipping that may otherwise occur with cover plates having a polymeric or painted surface and thereby remains aesthetically acceptable even over many cycles of use.

The housing 11 of the apparatus 10 includes a surface 14 adapted to support the article 16 to which the marker 18 is attached. The housing 11 also includes a vertical wall 20 which extends perpendicularly along the surface 14 and assists in maintaining bulky articles to which the markers may be affixed in contact with the surface 14 so that the fields provided by the magnet 13 will be able to magnetize the marker. Such an article could, for example, be a compact disc having a marker affixed near one edge of the package.

While the apparatus 10 may be used with the surface 14 in a horizontal position such that the article 16 may be moved across the horizontal surface, the apparatus may also be positioned to have its surface 14 in a vertical orientation, which would allow for bulkier articles to be moved across the apparatus.

The housing 11 of the apparatus 10, as shown in FIG. 1, is preferably constructed of non-magnetic materials, and may be fabricated from appropriately dimensioned and finished hardwood or may be formed from injection molded plastic. The bevelled faces provided in the housing 11 may be utilized to carry appropriate legends, manufacturer identification, instructions and the like.

In using the apparatus of FIG. 1, it will be recognized that the vertical wall 20 constrains the article 16 to be moved in the direction of arrow 22, thus ensuring that the desensitizable marker 18 affixed to one surface of the article passes over the magnet 13. Thus, for example, if the article 16 is a typically packaged compact disc, the marker 18 could be affixed to one side of the package so as to be positioned on the surface 14 of the housing 11 and passed therealong.

The marker 18 is typically constructed of an elongated strip of a high permeability, low coercive force ferromagnetic material such as permalloy, certain amorphous alloys, or the like. The strip is further provided with a plurality of high coercive force magnetizable sections 24. These sections are typically formed of a material such as vicalloy, armochrome, silicon steel or the like, typically having a coercive force in the range of 50 to 240 oersteds. When such sections are magnetized, the residual fields provided thereby magnetically bias the low-coercive-force strip and substantially alter the signal response produced in the presence of an interrogating field. The magnetization of the sections 24 is effected upon exposure to the fields provided by the magnet 13 when those sections are brought into close proximity with the magnet.

Figure 2:
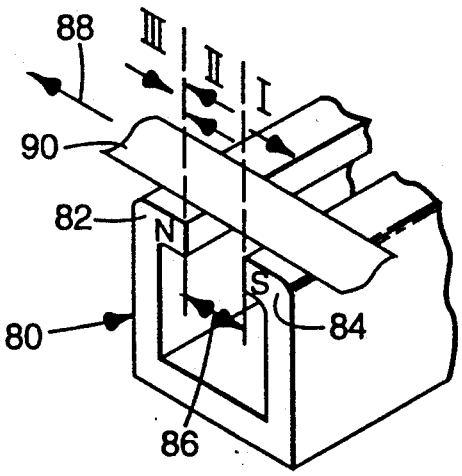
Fig. 2 PRIOR ART
FIG. 2 is a partial perspective view of a prior art magnet.

A prior art elongated magnet 80 is shown in FIG. 2. The elongated magnet 80 has a north pole 82 and a south pole 84 separated by a gap 86. A marker 90 approaching the magnet 80 (Region I) in the direction of arrow 88 would first see a weak magnet field pointing towards the right side of the page, as shown in FIG. 2. As the marker 90 passed over the gap 86 of the magnet 80 (Region II) it would be subjected to a strong magnetic field in the opposite direction (to the left) which magnetizes the marker. And as the marker 90 continued away from the gap 86 (Region III), it would be subjected to a weak "back" or reverse field (to the right), which could demagnetize the marker.

Figure 3:
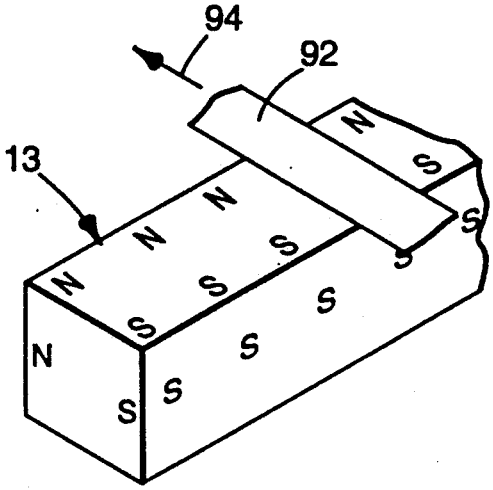
FIG. 3 is a partial perspective view of a magnet for use in the desensitizing apparatus shown in FIG. 1.

In constrast, the elongated magnet 13 used in the desensitizing apparatus 10 of the present invention has no gap, as shown in FIG. 3. The elongated magnet 13 provides a magnetic field aligned substantially normal to its length. The length of the magnet 13 is preferably within the range of from about 6 to 13 cm, and preferably about 10 cm. The magnet 13 preferably has a square-shaped cross-sectional area perpendicular to its length of less than about 1.3 mm by 1.3 mm, and more preferably about $1\times1$ mm. The magnet 13 has a peak magnetic energy product of at least about 15 Megagauss-oersteds, more preferably at least about 25 Megagauss-oersteds, and most preferably about 35 Megagauss-oersteds. The magnet 13 behaves like a dipole in that the north and south poles of the magnet are located on opposite surfaces of the magnet. Preferred magnet materials include rare earth, transition metal alloys, such as neodynium-iron-boron. A preferred neodynium-iron-boron elongated magnet having a peak energy product of 35 Megagauss-oersteds is available as ND-35 from Dexter Permag, Dexter Magnetic Materials Division, Chanhassen, Minn.

The elongated magnet 13 can be positioned in a non-magnetic plate (not shown) and is oriented so that the length of the magnet is substantially perpendicular to the direction of travel arrow 22 of the marker 18, as shown in FIG. 1. The magnet 13 can be positioned so that it provides a magnetic field either parallel to the surface 14 of the apparatus 10, perpendicular to it, or at any angle in between.

As shown in FIG. 3, a marker 92 approaching the magnet 13 in a direction 94 is subjected to an increasing field in one direction and, as the marker passes over the magnet and continues on it, is subjected to an equal and opposite magnetic field of decreasing strength. Thus, the marker 92 is subjected to only one magnetic field reversal, in contrast to the marker 90 in FIG. 2 which is subjected to two reversals. And unlike the magnetic field provided by the prior art magnet 80 of FIG. 2, it is believed that the decreasing magnetic field strength of the final (and only) reversal of the magnet 13 increases, rather than decreases, the magnetization of the marker 92. Thus, because the magnet 13 has no gap, a marker 92 passing over the magnet in a direction 94 is not subjected to a reversing back field which would partially resensitize, i.e. demagnetize, the marker 92.

The strength of the magnetic field over the magnet 13 caused by the magnet decreases by a factor of about $1/r^2$, for r greater than 1 mm, where r is a distance above the magnet, thereby enabling the marker 18 to be remanently magnetized without altering the magnetic state of the article 16. See EXAMPLE 3.

Figure 4:
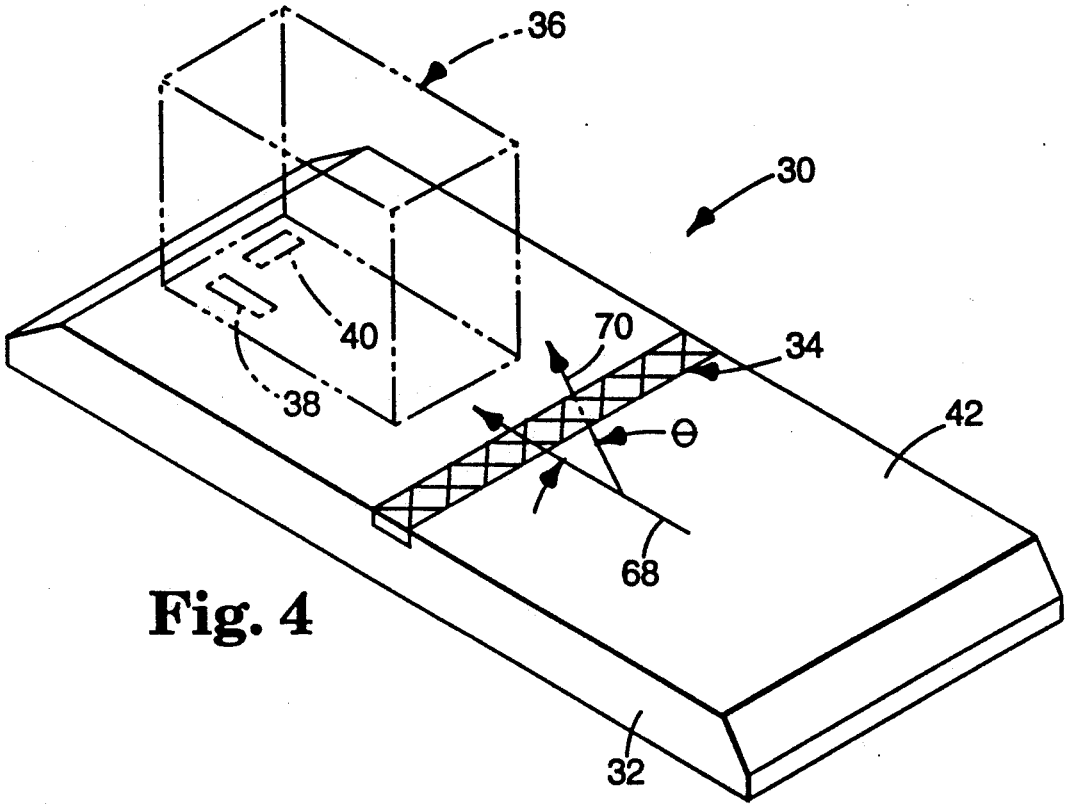
FIG. 4 is a perspective view of another embodiment of the desensitizing apparatus of the present invention.

Another embodiment of a desensitizing apparatus according to the present invention is shown as an apparatus 30 in FIG. 4. The apparatus 30 comprises a housing 32 and a magnet assembly 34. The apparatus 30 has a planar top surface 42 that is adapted to support an article 36 as it moves across the apparatus 30. The magnet assembly 34 is secured in a notch in the housing 32 so that the top of the magnet assembly is co-planar with the surface 42 of the housing. In the alternative, a cover sheet (not shown) similar to the cover sheet described above in conjunction with FIG. 1 may be used. Because the apparatus 30 has no vertical wall corresponding to the vertical wall 20 in FIG. 1, the apparatus can have a lower profile than that of the apparatus 10 in FIG. 1.

Figure 5:
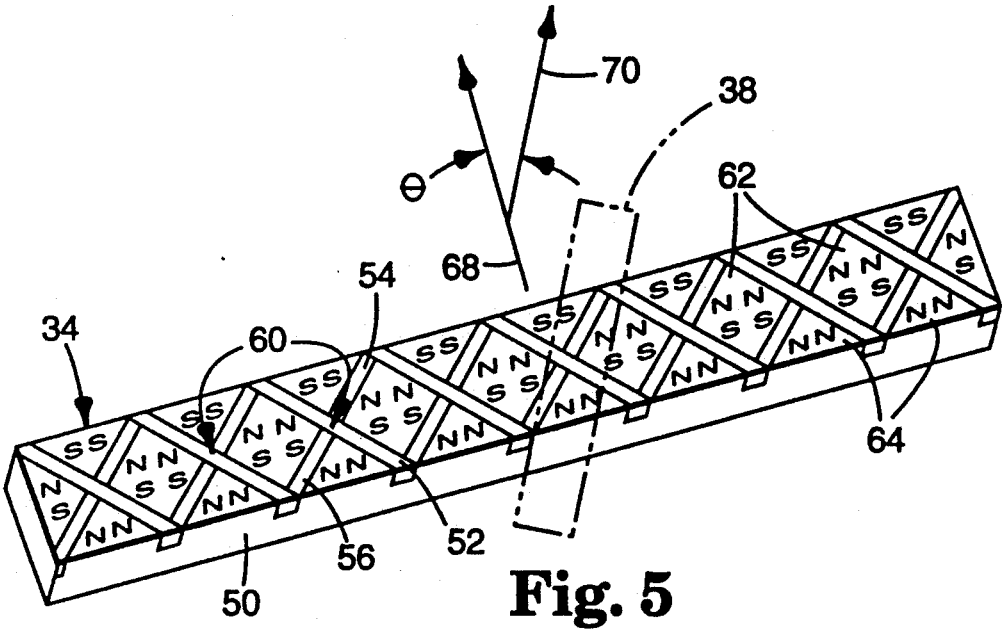
FIG. 5 is a perspective view of one embodiment of the permanent magnet assembly of the present invention.

The magnet assembly 34 is comprised of a plurality of elongated magnets embedded in a non-magnetic plate 50, as shown in FIG. 5. The plate 50 can be aluminum or any other non-magnetic material. The plurality of magnets is configured so as to create a row of X-shaped arrays 60 of elongated magnets. An elongated magnet 52 is oriented at an angle of about 45° with respect to the length of the non-metallic plate 50. An elongated magnet 54 is about half of the length of the elongated magnet 52, and extends from the midpoint of the length of the magnet 52, at an angle of about 90° to the length of the magnet 52. The two elongated magnets 54 and 56 are on opposite sides of the elongated magnet 52, as shown in FIG. 5. The three elongated magnets 52, 54, and 56 form the X-shaped array 60.

Because all of the elongated magnets embedded in the non-metallic plate 50 should be in the same plane, it is necessary to have two short elongated magnets for each long magnet in order to make an X-shaped array 60. While the elongated magnet 52 is shown as being twice as long as the elongated magnets 54 and 56 in FIG. 5, these could easily be reversed, i.e., the magnet 52 could be divided into two short magnets of equal length, and the magnets 54 and 56 could be combined to form one long magnet. In another variation, the long elongated magnet 52 could be divided into two short magnets having the same lengths as the two short magnets 54 and 56, thereby requiring the use of four short elongated magnets to form the X-shaped array 60.

The magnet assembly 34 includes several X-shaped arrays 60 in a row formed by having the ends of each X-shaped array 60 meet the ends of another X-shaped array. This row of X-shaped arrays 60 embedded in the non-magnetic plate 50 creates a plurality of squares 62 and triangles 64 of non-magnetic material between the elongated magnets.

The length of the row of X-shaped arrays 60 is preferably about the same length as the non-magnetic plate 50 in which they are embedded. This length should be large compared with the width of the plate 50 along the direction of arrow 68. The length of the magnet assembly 34 should be almost as wide, or as wide, as the width of the housing 32 of the apparatus 30. This ensures that markers 38 and 40 secured to the article 36 will be magnetized as they pass over the apparatus 30 even though their exact location on a particular side of the article is not known. So long as the article 36 passes over the magnet assembly 34, the markers 38 and 40 will also pass over it.

The rectangular markers 38 and 40 on the article 36 are perpendicular to each other. The magnet assembly 34 of the present invention desensitizes, i.e., magnetizes, both of the markers 38 and 40 as they pass over the magnet assembly. The magnet assembly 34 will also magnetize both of the markers 38 and 40 even if they pass over the magnet assembly in the direction of arrow 70 at an angle $\theta$ to the direction of the arrow 68, which represents a likely direction of travel of the markers over the magnet assembly and is perpendicular to the length of the magnet assembly. The magnet assembly 34 will magnetize the markers 38 and 40 even if they pass over the magnet assembly at an angle of $\theta=90°$ or 180°, so long as both markers actually pass over the magnet assembly.

Many different types of magnets may be used as the magnets 52, 54, and 56 that make up the magnet assembly 34. The magnets can be of the type disclosed in U.S. Pat. No. 4,499,444 (Heltemes et al.). Each elongated magnet should provide a magnetic field aligned substantially normal to its length and parallel to the non-magnetic plate 50.

The elongated magnets preferably have a peak magnetic energy product of at least about 15 Megagauss-oersteds, more preferably at least about 25 Megagauss-oersteds, and most preferably about 35 Megagauss-oersteds. The magnets should behave like dipoles in that their north and south poles are located on opposite surfaces of the magnet. Preferred magnetic materials include rare earth, transition metal alloys, such as neodynium-iron-boron, and more specifically ND-35 available from Dexter Permag.

The magnet 52 preferably has a length of about 1.8 cm and a square-shaped cross-sectional area perpendicular to its length of less than about 1.5 mm by 1.5 mm, and more preferably about 1.3 mm by 1.3 mm. The magnets 54 and 56 are about half the length of the magnet 52 but have the same cross-sectional area. The magnet assembly 34 preferably has dimensions of about 15 cm by 1.3 cm.

The magnet assembly 34 can be made by providing cross-hatched slots in the non-magnetic plate 50. Next, a magnetic fixture of the same size and shape of the magnet assembly 34, but with its directions of magnetization opposite to those desired for the magnet assembly, is clamped to the bottom of the non-magnetic plate 50. A suitable epoxy is then applied to the slots on the top of the non-magnetic plate 50. The elongated magnets are then brought into the vicinity of the slots. The magnetic field provided by the magnetic fixture then automatically aligns the magnets in the non-magnetic plate 50 so that they provide magnetic fields that are parallel to the magnetic plate. The magnetic fixture is then separated from the magnetic plate 50. The magnet assembly 34 and the top planar surface 42 of the housing 32 are then black anodized and hard-coated with polytetrafluoroethylene-coated aluminum.

If the preferred magnet described above is used in the magnet assembly 34, the magnet assembly will not subject the markers 38 and 40 passing over it to a back field that would partially resensitize the markers. The strength of the magnetic field over the magnet assembly 34 would decrease by about $1/r^2$, for r greater than 1 mm, where r is the distance perpendicular to the surface 42 of the housing 32. See EXAMPLE 3.

The present invention includes at least two elongated magnets that are perpendicular to each other. A marker passing over the magnets will be magnetized regardless of its orientation, and thus direction of travel with respect to the magnets, so long as the marker passes over both magnets (unless of course it passes over one of the magnets at an angle of $\theta=0°$, in which case it need not pass over the second magnet in order to be demagnetized). Because the two elongated magnets are perpendicular to each other, a marker which passes over one elongated magnet at an angle less than 45° will pass over the second elongated magnet at an angle greater than 45°. Thus, the perpendicular orientation guarantees that the marker will pass over at least one magnet at an orientation of at least 45°, which guarantees that the marker will be magnetized by a factor of at least sin (45°), or 0.71 of the strength of the magnet.

The magnets 54 and 52 can magnetize and thus desensitize any marker that passes over them, even if they are not adjacent each other. However, if the two perpendicular magnets 54 and 52 are not adjacent each other, there is a possibility that a marker to be sensitized passing over the first magnet might change direction before crossing the second magnet.

If only two magnets such as the magnets 54 and 52 are used, there is a possibility that the marker on the article will pass by the magnets without passing directly over both, or even one, of them. Accordingly, it is desirable to have a series of perpendicularly oriented magnets extending in a direction perpendicular to a likely direction of travel of a marker so that the marker will pass over the magnets regardless of its location on an article.

Figure 6:
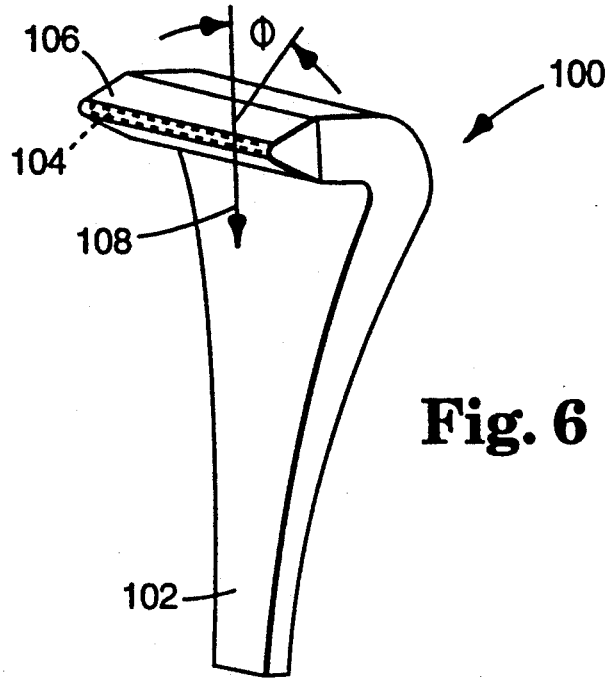
FIG. 6 is a perspective view of a hand-held desensitizing apparatus according to the present invention.

Yet another embodiment of the present invention is a hand-held desensitizing apparatus 100 shown in FIG. 6. The hand-held apparatus 100 includes a housing comprising a handle 102 and a head 106. The handle 102 is configured so that the apparatus 100 may be held by a hand. A magnet 104 preferably resembles the magnet 13 and is positioned in the head 106.

The hand-held apparatus 100 could be used to desensitize a marker on an article by moving the apparatus past the article in the direction of arrow 108, which is parallel to the plane of the magnet 104. The configuration of the head 106 and the magnetic properties of the magnet 104 also allow the apparatus 100 to magnetize markers which are oriented at an angle $\phi$ to the plane of the magnet.

The present invention will now be further described with regard to the following non-limiting examples.

EXAMPLE 1

A test was performed on the desensitizing apparatus 30 having the magnet assembly 34 shown in FIGS. 4 and 5 to measure how effective the apparatus was for desensitizing markers at various distances above the top planar surface 42 of the housing 32 (which was coplanar with the magnet assembly). The magnet assembly 34 was comprised of a row of X-shaped arrays of ND-35 magnets from Dexter Permag. Various markers were passed over the apparatus 30 at increasing heights over the apparatus until the markers were no longer desensitized because they were too far from the magnet assembly 34.

Two markers were tested: WH-0117 Whispertape TM rectangular markers, having a magnetic coercivity of 179 oersteds, and QTN Quadratag TM markers, having a coercivity of 81 oersteds, both of which are sold by 3M Company, St. Paul, Minnesota. The markers were moved past the magnet assembly 34 at angles of 0°, wherein the lengths of the marker were parallel to the length of the magnet assembly, at 45°, and at 90°, wherein the length of the marker was perpendicular to the length of the magnet assembly.

The same tests were performed on a Model 2001M desensitizer available from 3M Company, St. Paul, Minnesota. The 3M Model 2001M resembles the invention disclosed in U.S. Pat. No. 5,187,462 (Montean).

The results of the tests are shown in Table 1.

TABLE 1

| Marker | Angle | Distance in mm with 3M Model 2001M | distance in mm with Present Invention |
|---|---|---|---|
| WH117 | 0° | 1.0–1.25 | 1.5–1.75 |
| $H_c$ = 179 | 45° | 1.25–1.50 | 2.25–2.50 |
| | 90° | 2.0–2.25 | 2.25–2.50 |
| QTN | 0° | 4.75–5.0 | 5.5–5.75 |
| 1" × 1" | 45° | 4.75–5.0 | 5.5–5.75 |
| $H_c$ = 81 | 90° | 5.0–5.25 | 5.5–5.75 |

Both apparatuses were able to desensitize the rectangular marks at greater distances for the 90° orientation than the 0° orientation. Because the QTN Quadratag TM is shaped like a square, the distances at which the apparatuses were able to desensitize that marker were largely unaffected by the orientation of the markers.

The results in Table 1 demonstrate that the desensitizing apparatus of the present invention was able to desensitize the markers at greater distances than the 3M Model 2001M. This increased distance ranged from about 0.25 mm to 1.0 mm, and averaged about 0.5 mm overall.

It should be noted that one advantage of the present invention over the 3M model 2001M is that the magnet assembly of the present invention does not require the placement of a covering layer over the assembly (which is required in the 3M Model 2001M). This decreases the distance between the magnet assembly and the marker, thereby increasing the effectiveness of the apparatus.

EXAMPLE 2

A second test was performed on the same two desensitizing apparatuses used in Example 1 to determine how the apparatus 30 performed with markers secured to various articles in various locations on those articles for various orientations of the markers with respect to the magnet assembly 34. Markers were secured to various locations on audio cassettes, CD jewel boxes, digital compact cassettes, laser discs, and video tapes. The various markers on the various articles were then passed over the apparatus at angles of 0° (parallel), 45°, and 90° (perpendicular), as was done in Example 1. The results of the test are shown in Table 2.

TABLE 2

| Article | Marker Location | Distance in mm | 3M Model 2001M | Present Invention |
|---|---|---|---|---|
| Audio Cassette | inside front flap of J-card | 1.77 | 45°, 90° only | all angles |
| | long edge of cassette spine | 3.0 | 90° only | all angles |
| | inside bottom tray | 1.0 | all angles | all angles |
| CD Jewel Box | upper right corner | 2.2 | 45°, 90° only | all angles |
| | inside face of back paper insert | | | |
| | back face of CD tray | 3.2 | No | 90° only |
| | On the CD | 2.8 | No | 90° only |
| Digital Compact Cassette | on flat surface of cassette | 2.7 | all angles | all angles |
| | inside face of paper liner | 2.6 | all angles | all angles |
| Laser Disc | on the disc | 0.6 | all angles | all angles |
| | upper right corner of back face of package | 0.1 | all angles | all angles |
| Video Tape | upper right corner of back face of package | 0.7 | all angles | all angles |
| | inside face of gate | 1.8 | 45°, 90° only | all angles |
| | inside top cover | 0.7 | all angles | all angles |

Table 2 shows that the apparatus 30 having the magnet assembly 34 consistently was able to desensitize the various markers on the various articles over a wider range of angles than the 2001M. The apparatus 30 of the present invention desensitized the markers in audio cassettes in three different locations at all angles. The 3M model 2001M, in contrast, was able to desensitize only one of the markers for all angles, the second marker for 45° and 90° only, and the third marker for 90° only. The apparatus 30 of the present invention was able to desensitize CD jewel boxes having markers on the back face of the CD tray and on the CD itself at 90°, while the 3M Model 2001M did not desensitize those markers at any angle.

EXAMPLE 3

Figure 7:
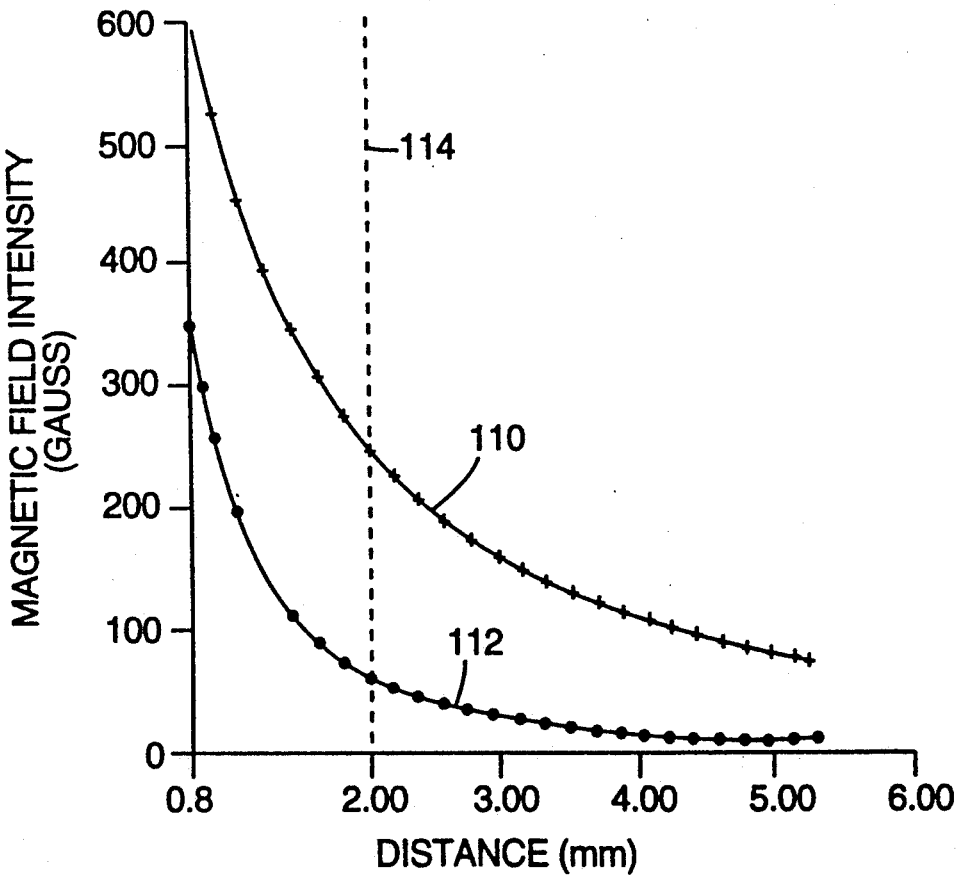
FIG. 7 is a graph showing the magnetic field of the magnet assembly of the present invention as a function of distance from the magnet assembly.

The magnetic field created by the magnet assembly 34 in the apparatus 30 of the present invention was measured as a function of distance from the top of the magnet assembly, i.e., the plane of the surface 42 of the housing 32. The same test was then carried out for the 3M Model 2001M. The resultant graph of magnetic field strength in gauss versus distance in millimeters from the article supporting surfaces of the two apparatuses is shown in FIG. 7. The curved line 110 represents the results for the 3M Model 2001M and the line 112 represents the apparatus 30 of the present invention.

The data was gathered with a Bell 610 Gauss Meter from F. W. Bell, Inc., Orlando, Fla. The Bell 610's probe could be placed no closer than 0.8 mm from the supporting surfaces of the two apparatus. The dotted line 114 corresponds to a distance of 2.0 mm, which represents the approximate distance to a magnetic tape in a cassette cartridge. The magnetic field strength at this distance is important because it is desirable to be able to magnetize, i.e., desensitize a marker on the inside of a cassette storage container without magnetizing the magnetic tape within the cassette, which would cause an audible disruption in the music recorded on the tape.

As shown in FIG. 7, the magnetic field strength (line 110) for the 3M Model 2001M decreases from an intensity of about 600 gauss at 0.8 mm to about 250 gauss at 2.00 mm, a decrease of 58%, or 1/2.4. This 2.4 fold decrease in magnetic field strength is matched by a 2.5 fold increase in distance (2.00 mm/0.8 mm). Similarly, at a distance of 3.60 mm, the magnetic field (line 110) of the 3M Model 2001M has dropped by a factor of 4.6, compared with a distance that has increased by a factor of 4.5. Thus, the rate of decrease for the 2001M is about 1/r, where r is the distance from the supporting surface to the marker.

In contrast, the magnetic field strength (line 112) for the apparatus 30 of the present invention falls off from an intensity of about 360 gauss at 0.8 mm to about 60 gauss at 2.0 mm, a decrease of 83%, or 1/6. This 6 fold decrease in magnetic field strength is matched by only a 2.5 fold increase in distance. And, at a distance of 3.60 mm, the magnetic field strength of the apparatus 30 (line 112) has dropped by a factor of 18 (to 20 gauss), compared with a distance that has increased by a factor of 4.5.

Thus, the rate of decrease is actually about $1/r^{1.9}$, for r greater than 1 mm. Thus, this rate of decrease exceeds the 1/r decrease of the 2001M, and falls within the preferred range of the present invention of about $1/r^2$, where about $1/r^2$ is defined as being within the range of from about $1/r^{1.7}$ to $1/^{2.1}$, for r greater than 1 mm. Accordingly, the drop-off of about $1/r^2$ of the magnetic field of the present invention makes it an excellent choice where it is desired to desensitize a marker without magnetizing the article to which the marker is attached.

I claim:

1. A desensitizing apparatus for magnetizing a desensitizable marker used with an electromagnetic article surveillance system, including:

a housing having a surface adapted to support an article as a marker secured thereto is moved past the apparatus, wherein the surface is further adapted to constrain said an article along a direction of travel over the housing; and an elongated, high density magnet positioned in a plane proximate to and substantially parallel with the surface of the housing adapted to support said an article, wherein the length of the magnet is substantially perpendicular to said a direction of travel of said a marker to be moved past the apparatus, wherein the magnet provides a magnetic field aligned substantially normal to its length, wherein the strength of the magnetic field decreases by about $1/r^2$, for r greater than 1 mm, where r is a distance above the magnet, thereby enabling the marker to be remanently magnetized without altering the magnetic state of the article to which the marker is affixed, and wherein the magnetic field is sufficiently strong to magnetize the marker but does not subject the marker to a back field which would partially resensitize the marker.

2. The desensitizing apparatus of claim 1, wherein the magnet is a rare earth, transition metal alloy magnet.

3. The desensitizing apparatus of claim 1, wherein the magnet has a peak magnetic energy product of at least about 25 Megagauss-oersteds and behaves like a dipole having north and south poles located on opposite surfaces of the magnet.

4. The desensitizing apparatus of claim 1, wherein the magnet has a square-shaped cross-section perpendicular to its length having dimensions of less than about 1.3 mm by 1.3 mm.

5. The desensitizing apparatus of claim 2, wherein the rare earth, transition metal alloy magnet comprises neodynium-iron-boron.

6. The desensitizing apparatus of claim 1, wherein the plane of the magnet is coplanar with the surface adapted to support said an article, whereby said an article may contact the magnet as the article is moved past the apparatus.

7. The desensitizing apparatus of claim 1, wherein the housing is adapted to be hand-held for transporting the apparatus relative to said an article to which said a marker is affixed.

8. A desensitizing apparatus for magnetizing a desensitizable marker used with an electromagnetic article surveillance system including:

a housing having a surface adapted to support an article as a marker secured thereto is moved past the apparatus; and first and second elongated magnets positioned in a plane proximate to and substantially parallel with the surface of the housing adapted to support said an article, wherein the lengths of the two magnets are substantially perpendicular to each other, wherein each magnet provides a magnetic field aligned substantially normal to its length and parallel to the surface of the housing adapted to support said an article, and wherein said a marker which passes over each of the magnets will be magnetized and thereby desensitized regardless of its orientation relative to the magnets.

9. The desensitizing apparatus of claim 8, wherein the length of the first elongated magnet is oriented at an angle of about 45° with respect to a likely direction of travel of said a marker to be magnetized.

10. The desensitizing apparatus of claim 9, further including a third elongated magnet, identical to the second elongated magnet, coplanar with the first and second magnets, wherein the second and third elongated magnets are each approximately one-half the length of the first elongated magnet, and wherein the lengths of the second and third magnets are substantially perpendicular to the length of the first elongated magnet and intersect the first magnet on opposite sides of the magnet at the midpoint of its length, thereby forming an X-shaped array of elongated magnets in the plane of the magnets.

11. The desensitizing apparatus of claim 10, further including a plurality of additional X-shaped arrays of elongated magnets, wherein the X-shaped arrays meet at their ends to form a straight row of X's, wherein the row is substantially perpendicular to said likely direction of travel of said a marker to be magnetized.

12. The desensitizing apparatus of claim 8, wherein each magnet has a peak magnetic energy product of at least about 25 Megagauss-oersteds and behaves like a dipole having north and south poles located on opposite surfaces of the magnet, and wherein said a marker passing the magnets is not exposed to a back field that would partially resensitize the marker.

13. The desensitizing apparatus of claim 12, wherein the magnets are rare earth, transition metal alloy magnets.

14. The desensitizing apparatus of claim 13, wherein the magnets comprise neodynium-iron-boron.

15. The desensitizing apparatus of claim 8, wherein the magnets each have a square-shaped cross-sectional area perpendicular to their length of less than about 1.5 mm by 1.5 mm.

16. The desensitizing apparatus of claim 8, wherein the plane of the magnets is coplanar with the surface adapted to support said an article, whereby said an article may contact the magnets as the article is moved past the apparatus.

17. A desensitizing apparatus for magnetizing a desensitizable marker used with an electromagnetic article surveillance system, including:

a housing having a surface adapted to support an article as a marker secured thereto is moved past the apparatus;

a rectangular, non-magnetic plate positioned in the housing in a plane proximate to and substantially parallel with the surface of the housing adapted to support said an article, wherein the length of the plate is substantially perpendicular to a likely direction of travel of said a marker to be magnetized, whereby the marker on said an article passing over the apparatus will also pass over the plate; and a plurality of X-shaped arrays of elongated magnets embedded on the plate, wherein each elongated magnet provides a magnetic field aligned substantially normal to its length and parallel to the plate, and wherein the X-shaped arrays meet at their ends to form a straight row of X's, wherein the row is parallel to the length of the plate.

18. The desensitizing apparatus of claim 17, wherein each of the X-shaped arrays of elongated magnets comprises:

a first elongated magnet oriented at an angle of about 45° to the length of the plate; and second and third elongated magnets, each of which is about one-half the length of the first elongated magnet, wherein their lengths are perpendicular to the length of the first magnet, they meet the first elongated magnet at the midpoint of its length, and wherein they are on opposite sides of the first elongated magnet.

19. The desensitizing apparatus of claim 17, wherein the surface adapted to support said an article does not cover the non-magnetic plate and the magnets embedded therein, whereby said an article may contact the plate as the article is moved past the apparatus.

20. The desensitizing apparatus of claim 17, wherein the magnets are rare earth, transition metal alloy magnets.

21. The desensitizing apparatus of claim 20, wherein the magnets comprise neodynium-iron-boron.

22. The desensitizing apparatus of claim 17, wherein the magnets each have a cross-sectional area perpendicular to their length of less than about 1.5 mm by 1.5 mm.

23. The desensitizing apparatus of claim 17, wherein each magnet has a peak magnetic energy product of at least about 25 Megagauss-oersteds and behaves like a dipole having north and south poles located on opposite surfaces of the magnet, and wherein said a marker passing the magnets is not exposed to a back field that would partially desensitize the marker.

24. The desensitizing apparatus of claim 17, wherein the strength of the magnetic field decreases by about $1/r^2$, for r greater than 1 mm, where r is a distance above the magnets, thereby enabling said a marker to be remanently magnetized without altering the magnetic state of said an article to which the marker is affixed.

* * * * *